US007520713B2

(12) United States Patent
Nishi et al.

(10) Patent No.: US 7,520,713 B2
(45) Date of Patent: Apr. 21, 2009

(54) BOOM ASSEMBLY

(75) Inventors: Ryoichi Nishi, Kawachinagano (JP); Naoki Onishi, Kawachinagano (JP); Arinobu Ishida, Sakai (JP); Shusaku Yamaguchi, Sennan (JP); Kosuke Oyama, Sakai (JP)

(73) Assignee: Kubota Corporation, Osaka (JP)

( * ) Notice: Subject to any disclaimer, the term of this patent is extended or adjusted under 35 U.S.C. 154(b) by 204 days.

(21) Appl. No.: 11/519,216

(22) Filed: Sep. 11, 2006

(65) Prior Publication Data

US 2007/0224027 A1 Sep. 27, 2007

(30) Foreign Application Priority Data

Mar. 27, 2006 (JP) ..... 2006-086356
Mar. 29, 2006 (JP) ..... 2006-092022

(51) Int. Cl.
*B66F 9/00* (2006.01)

(52) U.S. Cl. ..... 414/722; 29/891; 52/111

(58) Field of Classification Search ..... 414/722, 414/686; 52/111, 115, 732.1; 212/347, 348; 29/891, 891.1
See application file for complete search history.

(56) References Cited

U.S. PATENT DOCUMENTS 2,701,072 A * 2/1955 Chambers et al. ..... 414/686
7,354,238 B2 * 4/2008 Fukudome et al. ..... 414/686
2003/0223851 A1 * 12/2003 Muramoto ..... 414/686

FOREIGN PATENT DOCUMENTS

JP 63140726 6/1988
JP 6313325 11/1994
JP 1158907 6/1999

* cited by examiner

*Primary Examiner*—Donald Underwood
(74) *Attorney, Agent, or Firm*—The Webb Law Firm

(57) ABSTRACT

There is provided a boom assembly bent at the center in a longitudinal direction so as to form a round shape protruding upward when seen from the side, comprising; a front boom sub assembly (47), the front boom sub assembly constituting the front of the center in the longitudinal direction of said boom assembly; and a rear boom sub assembly (48), the rear boom sub assembly constituting the rear of the center in the longitudinal direction of the boom assembly, wherein the front boom sub assembly (47) and the rear boom sub assembly (48) are symmetric when seen from the side, and portions from the midway positions in the longitudinal direction of the front boom sub assembly (47) and the rear boom sub assembly (48) to the center in the longitudinal direction of the boom assembly (12) have upper surfaces of arc shape protruding upward when seen from the side, and portions from the middles in the longitudinal direction of the front boom sub assembly (47) and the rear boom sub assembly (48) to ends in the longitudinal direction of the boom assembly (12) have upper surfaces of linear shape when seen from the side.

7 Claims, 8 Drawing Sheets

BOOM ASSEMBLY

BACKGROUND OF THE INVENTION

1. Field of the Invention

The present invention relates to a boom assembly of an operating machine such as a front loader.

2. Description of the Related Art

A boom assembly of a front loader includes a boom assembly formed by joining a front boom sub assembly on the front of the center in a longitudinal direction of the boom assembly, and a rear boom sub assembly on the rear of the center in the longitudinal direction of the boom assembly (for example, see Japanese Patent Application "kokai" No. 11-158907).

A boom assembly of a front loader also includes a round boom assembly bent at the center in a longitudinal direction so as to form a round shape protruding upward when seen from the side (for example, see Japanese Patent Application "kokai" No. 11-158907 and Japanese Patent Application "kokai" No. 6-313325).

A boom assembly of a front loader further includes a boom assembly in which a body portion is formed into an angle protruding upward when seen from the side by bending a flat sheet material into a Π-shape in section opening downward and then further bending the flat sheet material at the center in a longitudinal direction of the boom assembly (for example, see Japanese Patent Publication No. 7-108410).

SUMMARY OF THE INVENTION

The round boom assembly bent at the center in the longitudinal direction so as to form the round shape protruding upward when seen from the side has good appearance. However, it is difficult to form the round boom assembly from one member from a front end to a rear end.

Thus, it is considered that the round boom assembly bent at the center in the longitudinal direction so as to form the round shape protruding upward when seen from the side is fabricated to include a front boom sub assembly on the front of the center in a longitudinal direction, and a rear boom sub assembly on the rear of the center in the longitudinal direction. For forming body portions of the front and rear boom sub assembly, for example, a boom forming member cut out of a flat sheet material is bent into an inverted u-shape constituted by right and left side walls and an upper wall connecting upper edges of the right and left side walls and then bent into a round shape protruding upward.

When a body of each of the front and rear boom sub assemblies is formed into a round shape protruding upward from one end to the other end in the longitudinal direction, and plural types of boom assemblies having different lengths are fabricated, plural types of boom sub assemblies having different lengths can be fabricated by one press die with the bodies of the front and rear boom sub assemblies having the same radius of curvature. However, in a front loader in which a bucket cylinder for swinging a bucket provided swingably at a tip of the boom assembly is placed in an upper front of the boom, expanding and contracting the bucket cylinder for swinging the bucket vertically swings the bucket cylinder, and causes the bucket cylinder to be moved close to or away from an upper surface of the boom. Thus, considering avoiding interference between the bucket cylinder and the boom, it is difficult in design to fabricate plural types of boom sub assemblies in each of which a front boom sub assembly is formed into a round shape protruding upward from one end to the other end in a longitudinal direction, and that have arcs with the same radius of curvature and different lengths.

Thus, the boom sub assemblies of the round boom assembly are formed to have radii of curvature corresponding to the lengths, thereby solving the problem. In this case, however, press dies corresponding to the boom sub assemblies having different lengths need to be made to increase costs, and a die changing step is required in fabrication of the boom assemblies having different lengths, thereby reducing productivity and increasing labor costs.

Therefore, the present invention has an object to provide a boom assembly that solves the problem.

In order to solve the technical problem, the following technical means are taken.

Specifically, there is provided a boom assembly bent at the center in a longitudinal direction so as to form a round shape protruding upward when seen from the side, comprising;

a front boom sub assembly, the front boom sub assembly constituting the front of the center in the longitudinal direction of the boom assembly; and a rear boom sub assembly, the rear boom sub assembly constituting the rear of the center in the longitudinal direction of the boom assembly, wherein the front boom sub assembly and the rear boom sub assembly are symmetric when seen from the side, and portions from the midway positions in the longitudinal direction of the front boom sub assembly and the rear boom sub assembly to the center in the longitudinal direction of the boom assembly have upper surfaces of arc shape protruding upward when seen from the side, and portions from the middles in the longitudinal direction of the front boom sub assembly and the rear boom sub assembly to ends in the longitudinal direction of the boom assembly have upper surfaces of linear shape when seen from the side.

Bodies of the front boom sub assembly and the rear boom sub assembly may be formed into an inverted u-shape in section by right and left side walls and an upper wall connecting upper edges of the right and left side walls.

The boom assembly includes an operating tool swingably at a front end of the boom assembly, and is suitably adopted in a loader in which a hydraulic cylinder that swings the operating tool is placed in an upper front of the boom assembly.

When a round boom assembly comprising a front boom sub assembly and a rear boom sub assembly, and bent at the center in a longitudinal direction so as to form a round shape protruding upward when seen from the side is adopted in a front loader in which a hydraulic cylinder that swings an operating tool swingably provided at a front end of the boom assembly is placed in an upper front of the boom assembly, the front boom sub assembly that constitutes the front of the boom assembly being formed into an arc shape protruding upward from one end to the other end, it is difficult in design in forming boom assemblies having different lengths to form front boom sub assemblies having the same radius of curvature in view of avoiding interference with the hydraulic cylinder. Thus, the front boom sub assemblies have to be formed into arc shapes with different radii of curvature, which requires a plurality of press dies.

On the other hand, according to the present invention, the boom assembly is formed so that the portion from the middles in the longitudinal direction to the center in the longitudinal direction of the boom assembly has the upper surface of arc shape protruding upward when seen from the side, and the portions from the middles in the longitudinal direction to the ends in the longitudinal direction of the boom assembly have the upper surfaces of linear shape when seen from the side. Thus, even if the boom sub assemblies are formed to have linear portions with different lengths to form arc portions with the same radius of curvature in fabricating boom assemblies having different lengths, the problem can be easily addressed of avoiding interference between the hydraulic cylinder and the boom assembly in each of the boom assemblies having different lengths.

Thus, the boom sub assemblies having different lengths can be formed to have arc portions with the same radius of curvature, and the front and rear boom sub assemblies are symmetric in the front and rear when seen from the side, thereby minimizing fabrication of press dies for forming the arc portions to reduce costs, and reduce a die changing time, increase productivity, and reduce labor costs in fabrication of the boom assemblies having different lengths.

DETAILED DESCRIPTION OF PREFERRED EMBODIMENTS

Now, an embodiment of the present invention will be described with reference to the drawings.

Figure 2:
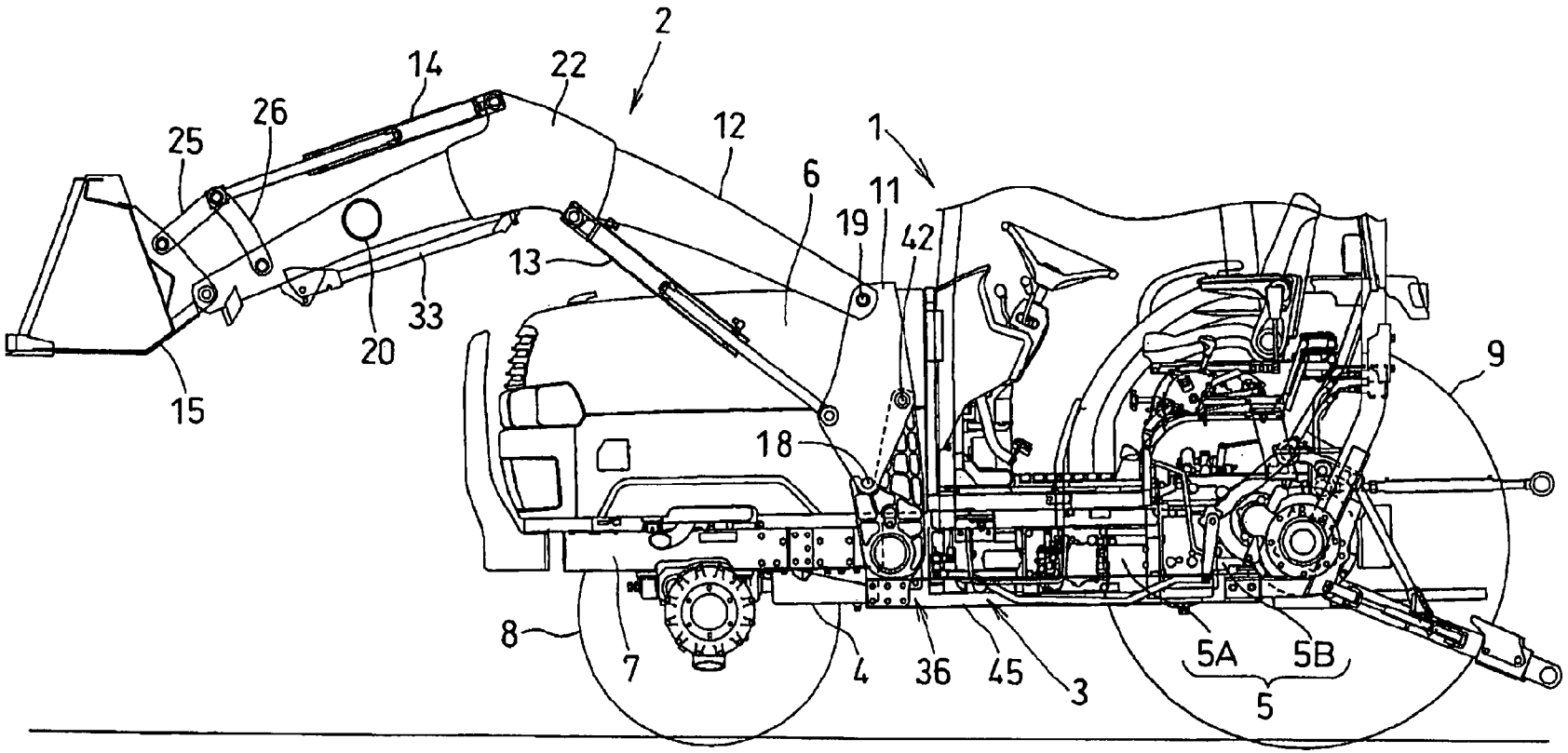
FIG. 2 is a side view of a tractor to which the front loader is mounted.

In FIG. 2, reference numeral 1 denotes a tractor (running vehicle), and reference numeral 2 denotes a front loader (loader) removably mounted to the front of the tractor 1. A vehicle body 3 of the tractor 1 mainly includes an engine 4 in the front, a flywheel housing connected to the rear of the engine 4, and a transmission case 5 connected to the rear of the flywheel housing, and the transmission case 5 includes a front clutch housing 5A and a rear transmission case 5B.

Figure 1:
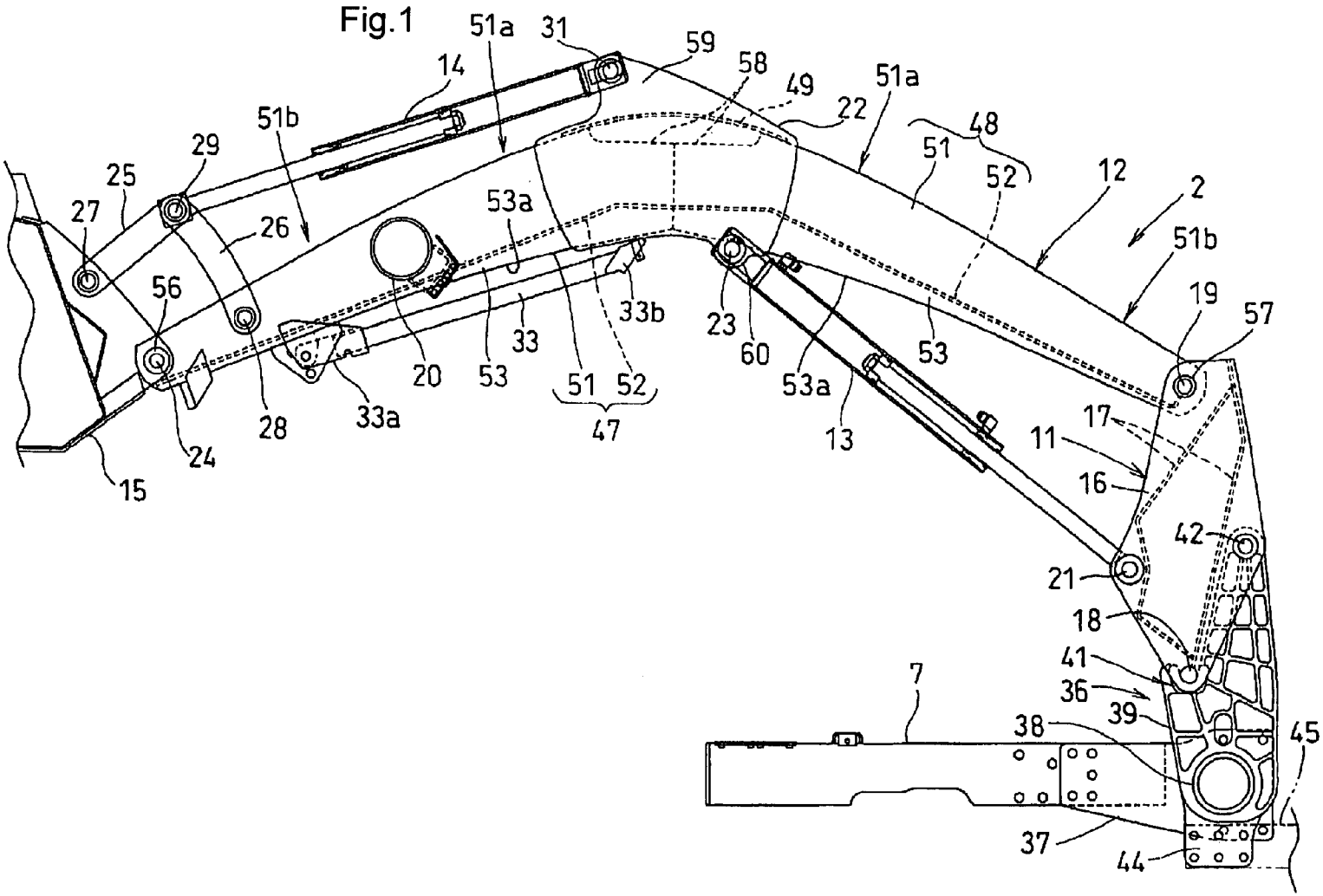
FIG. 1 is a side view of a front loader.

The engine 4 is covered with a hood 6, and a front axle frame 7 is mounted and secured to a lower portion of the engine 4 so as to protrude forward from the engine 4. A pair of right and left front wheels 8 are supported by the front axle frame 7, and a pair of right and left rear wheels 9 are supported in the rear of the transmission case 5. The vehicle body 3 of the tractor 1 is drivably supported by the pairs of right and left front and rear wheels 8 and 9. Also as shown in FIG. 1, the front loader 2 includes a pair of right and left side frames 11, a pair of right and left boom assemblies 12, a pair of right and left boom cylinders 13, a pair of right and left bucket cylinders 14, and one bucket 15 (operating tool).

Each of the right and left side frames 11 mainly includes a pair of right and left side plates 16, and a connection plate 17 connecting the right and left side plates 16, and an engagement pin 18 provided across the right and left side plates 16 is provided in a lower end. The right and left boom assemblies 12 are connected at bases (rear ends) to upper portions of the side frames 11 on the same lateral sides pivotably around a lateral shaft by a pivot 19, and the right and left boom assemblies 12 are connected at the front by a connecting member 20 made of a cylindrical pipe material.

The boom cylinders 13 include hydraulic cylinders, and the right and left boom cylinders 13 are placed in lower rear portions of the boom assemblies 12 on the same lateral side (below a rear boom sub assembly 48 described later), one ends of the boom cylinders 13 (rear ends, tips of piston rods) are connected to the middles in a vertical direction of the fronts of the side frames 11 on the same lateral side pivotably around a lateral shaft by a pivot 21, and the other ends of the boom cylinders 13 (front ends, bottom ends of the cylinders) are connected to cylinder pivot portions 60 in lower ends of the rears of the pair of right and left bracket plates 22 provided in the middles in the longitudinal direction of the boom assemblies 12 pivotably around a lateral shaft by a pivot 23, and the boom cylinders 13 are expanded and contracted (the piston rods are protruded and retracted) to vertically swing the boom assemblies 12 around the pivot 19.

The bucket 15 is connected at a lower back portion to tips (front ends) of the right and left boom assemblies 12 pivotably around a lateral shaft by a pivot 24, one ends of first links 25 are connected to a back side of the bucket 15 pivotably around a lateral shaft by a pivot 27, and the other ends of the first links 25 are connected to the other ends of second links 26 pivotably around a lateral shaft by a pivot 29, the second links 26 having one ends connected to the tips of the boom assemblies 12 pivotably around a lateral shaft by a pivot 28.

The bucket cylinders 14 include hydraulic cylinders, and placed above the fronts of the boom assemblies 12 on the same lateral side (above a front boom sub assembly 47 described later), one ends of the bucket cylinders 14 (rear ends, bottom ends of the cylinders) are connected to cylinder pivot portions 59 in the fronts of upper ends of the bracket plates 22 pivotably around a lateral shaft by a pivot 31, the other ends of the bucket cylinders 14 (front ends, tips of piston rods) are connected to connecting portions between the first links 25 and the second links 26 pivotably around a lateral shaft by the pivot 29, the bucket cylinders 14 are expanded and contracted (the piston rods are protruded and retracted) to vertically swing the bucket 15 (scooping and dumping operation). At this time, the boom cylinders 14 vertically swing around the pivot 31 to be moved close to and away from the boom assemblies 12.

In the front loader 2, a stand 33 is provided that supports the boom assemblies 12 with the bucket 15 being grounded when the front loader 2 is removed from the tractor 1. The stand 33 includes a front end 33*a* connected to lower sides of the boom assemblies 12 pivotably around a lateral shaft, and a grounded portion 33*b* in a rear end removably locked to the lower sides of the boom assemblies 12, and is changeable in position between a non-use position along the boom assemblies 12 and a use position swung downward from the non-use position. On the other hand, in the tractor 1, a loader mounting frame 36 for removably mounting the front loader 2 is provided.

The loader mounting frame 36 includes, as shown in FIG. 1, a pair of right and left mounting plates 37 mounted and secured to the vehicle body 3 of the tractor 1, a pair of right and left support bases 38 provided to protrude laterally outward from the vehicle body 3 of the tractor 1, and a pair of right and left main frames 39 standing on the support bases 38, and the mounting plates 37, the support bases 38, and the main frames 39 are placed on the right and left of the vehicle body 3 of the tractor 1. Each mounting plate 37 is formed of one steel sheet, placed in a lower rear portion of the engine 4 and the side in a lower portion of the flywheel housing, the front is secured by bolts to an outer surface of the front axle frame 7, and upper and lower portions of the rear are secured by bolts to an outer surface of the flywheel housing.

Each support base 38 is formed of a cylindrical pipe material having a lateral axis, and a lateral inner end thereof is joined by welding to the rear of the mounting plate 37. Each main frame 39 is formed of one cast steel sheet, and joined by welding at a lower portion to a lateral outer end of the support base 38. In the middle in a vertical direction of the front of the main frame 39, a receiving portion 41 is provided into which the engagement pin 18 provided in the lower portion of the side frame 11 is fitted from above to be received.

An upper portion of the main frame 39 is connected to the side frame 11 by a connection pin 42 inserted through the main frame 39 and the middle in the vertical direction of the rear of the side frame 11. In the front loader 2 having the above described configuration, the engagement pin 18 of the side frame 11 fits into the receiving portion 41 of the main frame 39 from above with an upper front portion of the main frame 39 being inserted between the right and left side plates 16 of the side frame 11. The connection pin 42 is inserted through the upper portion of the main frame 39 and the middle in the vertical direction of the rear of the side frame 11 with the engagement pin 18 being received in the receiving portion 41, thus the side frame 11 is mounted to the main frame 39, and the front loader 2 is supported by the loader mounting frame 36.

For removing the front loader 2 from the tractor 1, for example, first, the connection pin 42 is removed with the tip of the bottom of the bucket 15 being grounded and the stand 33 being lowered from the non-use position to the use position, then the bucket cylinder 14 is contracted in this state to lower the boom assembly 12 and cause the stand 33 to be grounded. After the stand 33 is grounded, the boom assembly 12 swings around the grounded portion of the stand 33 so as to raise the side frame 11, and the engagement pin 18 of the side frame 11 is removed upward from the receiving portion 41 of the main frame 39, and thus the front loader 2 enters a standing state where the boom assembly 12 is supported by the stand 33 with the bottom of the bucket 15 being grounded.

A bracket 44 extending downward from the lower end of the main frame 39 is integrally formed with the lower end of the main frame 39, and a front end of a sub frame 45 is secured to the bracket 44 by bolts, the sub frame 45 extends rearward along the vehicle body 3 of the tractor 1, and the rear end is connected to a member secured to the transmission case 5B.

Figure 3:
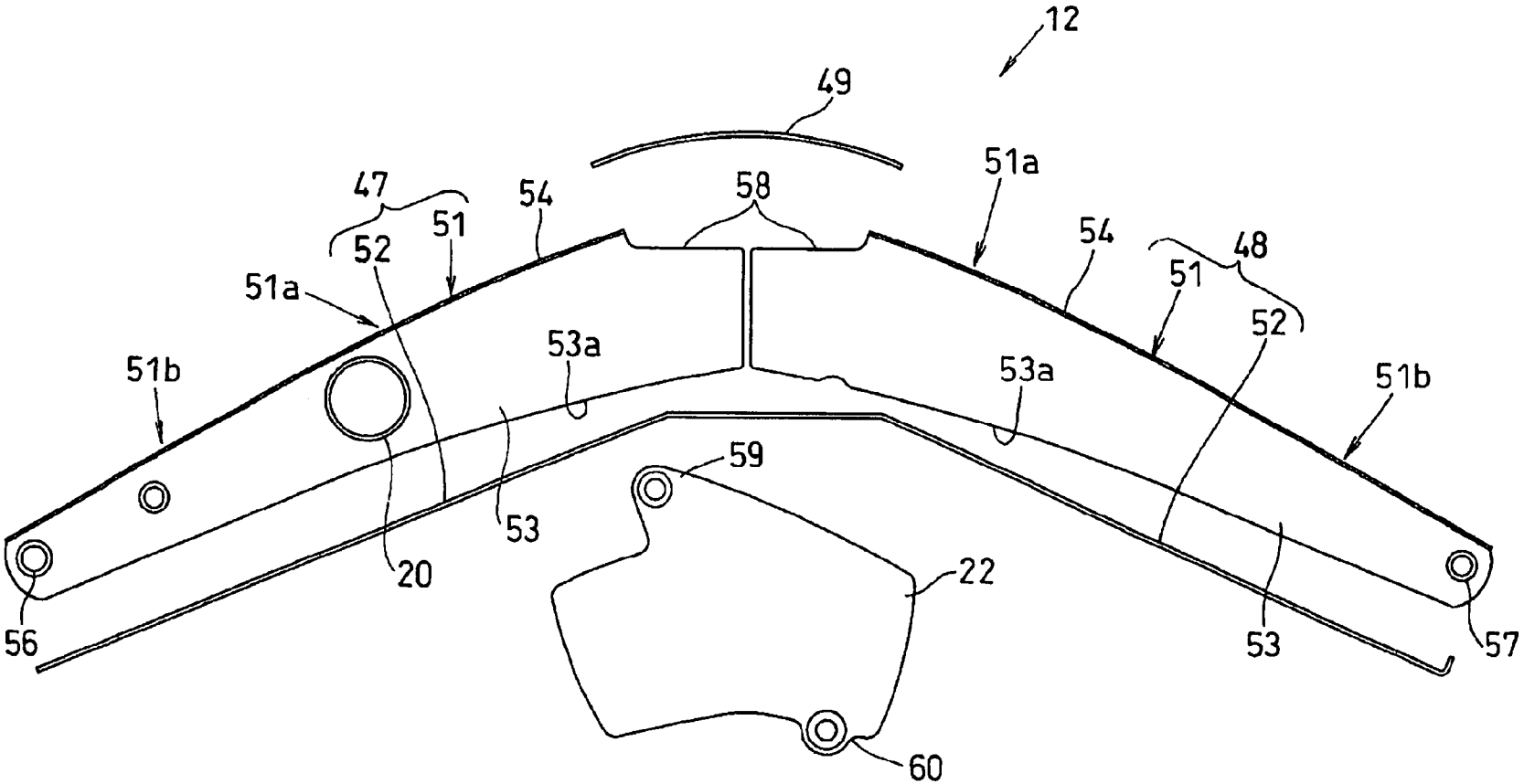
FIG. 3 is an exploded side view of a boom assembly.

As shown in FIGS. 1 and 3, the right and left boom assemblies 12 are bent into a curve at the center in the longitudinal direction so as to form a round shape protruding upward when seen from the side, and have gradually increasing vertical widths from the front and rear ends toward the center in the longitudinal direction.

The boom assembly 12 mainly includes a front boom sub assembly 47 on the front of the center in the longitudinal direction of the boom assembly 12, a rear boom sub assembly 48 on the rear of the center in the longitudinal direction of the boom assembly 12, and a center connection plate 49 connecting the front and rear boom sub assemblies 47 and 48 at the center in the longitudinal direction of the boom assembly 12. The front and rear boom sub assemblies 47 and 48 are each constituted by a body 51 and a bottom plate 52, and the bodies 51 of the front and rear boom sub assemblies 47 and 48 have the same shape (symmetric in the front and rear when seen from the side), thereby achieving sharing of members.

The body 51 of each of the boom sub assemblies 47 and 48 is formed into an inverted u-shape in section opening downward by a pair of right and left side walls 53 and an upper wall 54 connecting upper edges of the right and left side walls 53.

In the body 51 of each of the front and rear boom sub assemblies 47 and 48, a portion of each of the front and rear boom sub assemblies 47 and 48 from the middle in the longitudinal direction to the end at the center in the longitudinal direction of the boom assembly 12 is a round portion 51*a* having an upper surface of arc shape protruding upward when seen from the side, and a portion of each of the boom sub assemblies 47 and 48 from the middle in the longitudinal direction to the end in the longitudinal direction of the boom assembly 12 is a linear portion 51*b* having an upper surface of linear shape when seen from the side.

The body 51 of each of the front and rear boom sub assemblies 47 and 48 are formed into an inverted u-shape in section by bending (pressing) one boom forming sheet material cut out of a flat sheet material into a predetermined shape to form the right and left side walls 53 and the upper wall 54, the walls are bent into an inverted u-shape, then the boom sub assemblies 47 and 48 are bent (pressed) into a curve protruding upward at the centers in the longitudinal direction of the boom assembly 12 to form the round portions 51*a*, and the linear portions 51*b* are not bent into a curve. For forming the round portions 51*a* into an arc shape, for example, a press die is provided constituted by a female mold having a concave surface and placed above the boom sub assemblies 47 and 48 so that the concave surface faces upper surfaces of the boom sub assemblies 47 and 48, and a male mold having a convex surface and placed below the boom sub assemblies 47 and 48 so that the convex surface faces lower edges 53*a* of the side walls of the boom sub assemblies 47 and 48, and the boom sub assemblies 47 and 48 are press molded between the female mold and the male mold to form the round portions 51*a*.

Thus, in the round portion 51*a*, the lower edge 53*a* of the side wall 53 is also formed into an arc shape protruding upward, and in the linear portion 51*b*, the lower edge 53*a* of the side wall is also formed into a linear shape when seen from the side. The shape seen from the side of the lower edge 53*a* of the side wall 53 is determined in a cutting-out stage, and thus not limited to the arc shape or the linear shape. The bodies 51 of the front and rear boom sub assemblies 47 and 48 thus formed are abutted and joined by welding at ends of the side walls 53 at the center in the longitudinal direction of the boom assembly 12.

For the boom assembly 12 having the above described configuration, in fabrication of boom assemblies 12 having different lengths, the round portions 51*a* of the bodies 51 of the boom sub assemblies 47 and 48 are formed by one press die with the radii of curvature of arcs thereof being the same, and the lengths of linear portions 51*b* are made different to form the boom sub assemblies 47 and 48 having different lengths. The lengths of the boom sub assemblies 47 and 48 are determined in the stage of cutting out the flat sheet material. In the front end of the front boom sub assembly 47, a front pivot portion 56 is provided made of a cylinder, passing through the right and left side walls 53, and secured to the side walls 53 by welding, and a bucket 15 is connected to the front pivot portion 56 pivotably around a lateral shaft by the pivot 24.

In the rear end of the rear boom sub assembly 48, a rear pivot portion 57 is provided made of a cylinder, passing through the right and left side walls 53, and secured to the side walls 53 by welding, and the side frames 11 are connected to the rear pivot portion 57 rotatably around a lateral shafts by the pivot 19. The middles of the right and left side walls 53 of the right and left front boom sub assemblies 47 are connected by the connecting member 20. The bottom plate 52 is formed of a flat sheet, placed below the upper wall 54 and between the right and left side walls 53, and provided so as to extend from the ends of the front and rear boom sub assemblies 47 and 48 at the center in the longitudinal direction of the boom assembly 12 to the front and rear pivot portions 56 and 57.

In the embodiment, the bottom plate 52 of the front and rear boom sub assemblies 47 and 48 is integrally formed of one sheet, and secured to the bodies 51 by welding when (or after) the bodies 51 of the front and rear boom sub assemblies 47 and 48 are joined together. Bottom plates 52 of the front and rear boom sub assemblies 47 and 48 may be formed separately. A rear end of the bottom plate 52 of the rear boom sub assembly 48 is secured to the rear pivot portion 57 by welding. A front end of the bottom plate 52 of the front boom sub assembly 47 may be also secured to the front pivot portion 56 by welding. On the other hand, on a bottom side of one of the right and left boom assemblies 12, hydraulic pipes for the boom cylinder 13 and the bucket cylinder 14 are provided along the bottom plate 52 from the rear to the connecting member 20, the hydraulic pipes are provided below and along the connecting member 20 to the other of the right and left boom assemblies 12, the middles of the hydraulic pipes or the ends thereof on the side of the other boom assembly 12 are connected to the boom cylinder 13 and the bucket cylinder 14 via hydraulic hoses, and rear ends of the hydraulic pipes are connected to a control valve provided in the main frame 39 or the like via the hydraulic hoses.

For the bottom plate 52 of the front and rear boom sub assemblies 47 and 48, the bottom plate 52 at the end in the longitudinal direction of the boom assembly 12 is close to the lower edge 53*a* of the side wall 53 of the body 51, the bottom plate 52 at the center in the longitudinal direction of the boom assembly 12 is positioned in the middle in a vertical width direction at the center in the longitudinal direction of the boom assembly 12 (a middle in the vertical direction of an edge of the side wall 53 at the center in the longitudinal direction of the boom assembly 12).

Thus, a distance from the bottom plate 52 to the lower edge 53*a* of the side wall 53 is long at the center in the longitudinal direction of the boom assembly 12, and a housing space for the hydraulic pipes is large at the center in the longitudinal direction of the boom assembly 12.

The distance from the bottom plate 52 to the lower edge 53*a* of the side wall 53 is long at the center in the longitudinal direction of the boom assembly 12, and a width between the right and left side walls 53 is narrow, thus in welding the bottom plate 52 to the side walls 53, a welding torch is hard to be placed between the side walls 53 at the center in the longitudinal direction of the boom assembly 12, and welding of the bottom plate 52 to the side walls 53 is difficult at the center in the longitudinal direction of the boom assembly 12. Thus, notches 58 are formed in upper portions of the bodies 51 of the front and rear boom sub assemblies 47 and 48 at the center in the longitudinal direction of the boom assembly 12, the bottom plate 52 is welded to the side walls 53 from below from the front and rear ends of the boom assembly 12 to the middles in the longitudinal direction of the boom sub assemblies 47 and 48, and the bottom plate 52 is welded to the side walls 53 from above via the notches 58 at the center in the longitudinal direction of the boom assembly 12.

The notches 58 are formed in the upper walls 54 by cutting a predetermined range in the longitudinal direction of the boom from the ends of the upper walls 54 at the center in the longitudinal direction of the boom assembly 12, and formed so as to extend from the notch portions in the upper walls to the right and left side walls 53.

The center connection plate 49 is formed by bending a flat sheet into a curve protruding upward, and provided across the upper walls 54 of the front and rear boom sub assemblies 47 and 48 so as to close the notches 58 from above. The bracket plates 22 are placed on the right and left of the boom assembly 12 at the center in the longitudinal direction of the boom assembly 12, provided across the side walls 53 of the front and rear boom sub assemblies 47 and 48, and placed on outer surfaces of the side walls 53 of the front and rear boom sub assemblies 47 and 48 and secured by welding. Thus, the bracket plates 22 also serve as reinforcing plates.

Figure 4:
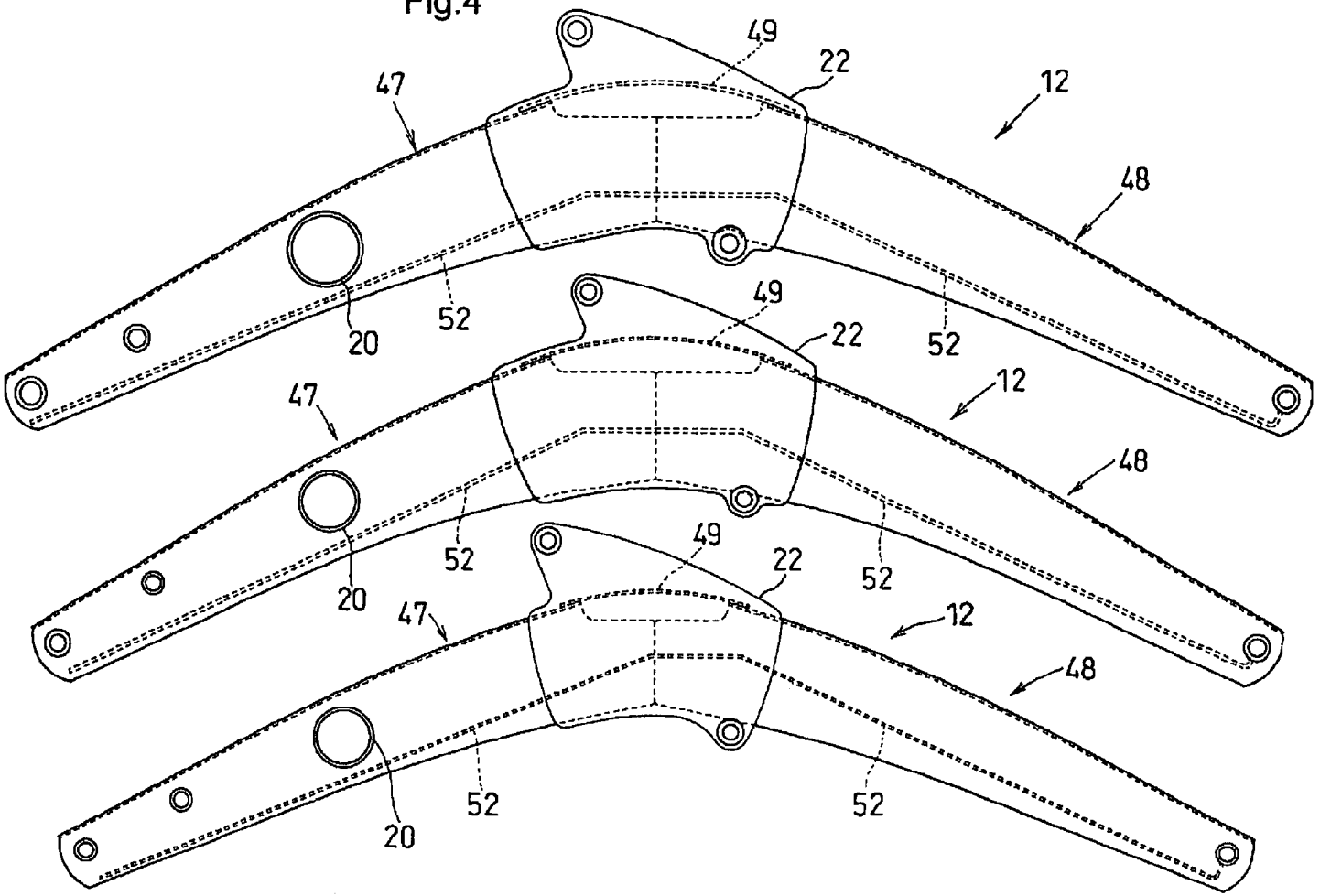
FIG. 4 is a side view of boom assemblies having different lengths.
Figure 5:
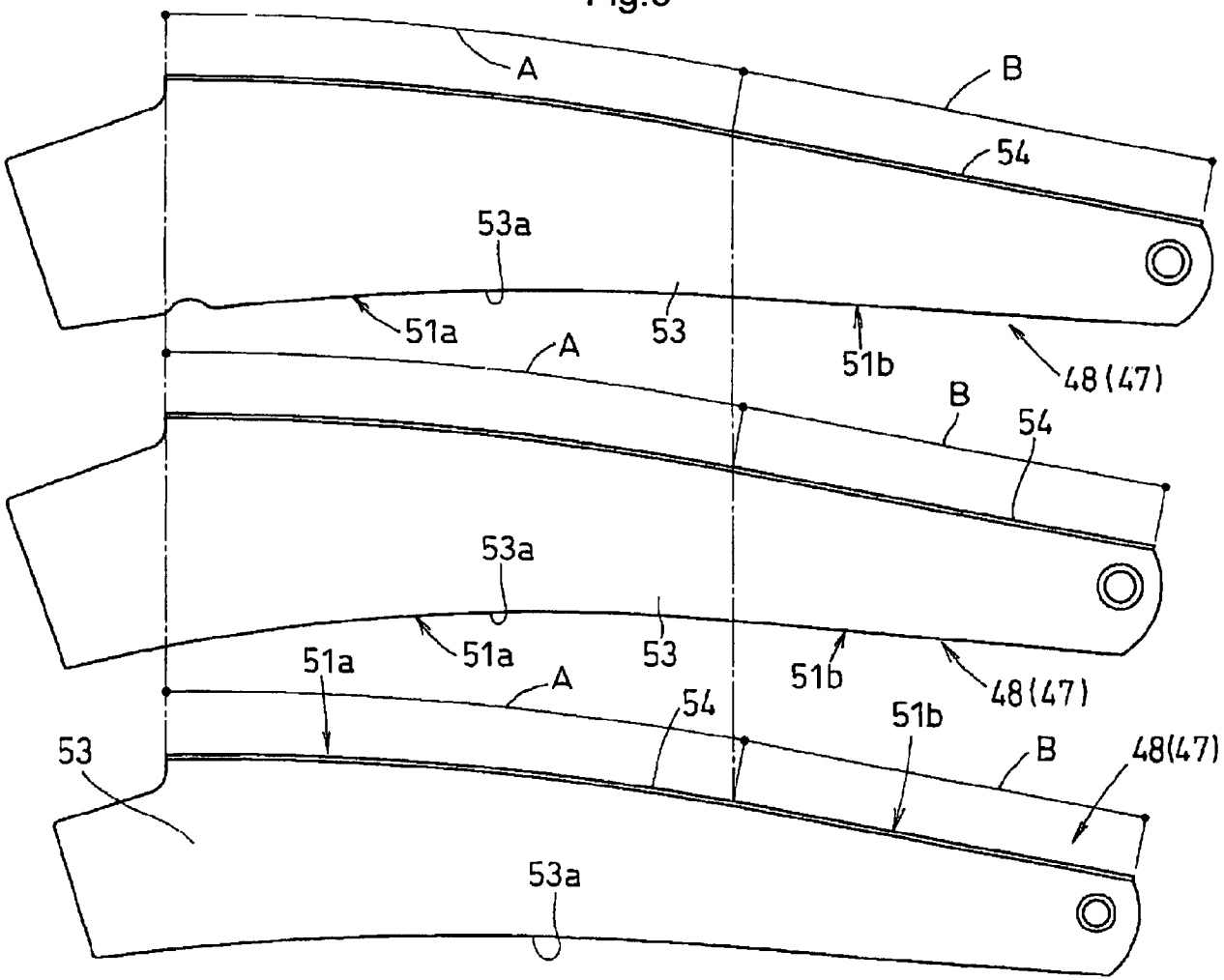
FIG. 5 is a side view of boom sub assemblies having different lengths.

FIG. 4 shows three types of round boom assemblies 12 of the embodiment having different lengths, and FIG. 5 shows boom sub assemblies 47 and 48 of the three types of boom assemblies 12 in FIG. 4. The boom sub assemblies 47 and 48 of the three types of boom assemblies 12 having different lengths are formed so that radii of curvature of arcs of upper walls 54 at round portions 51*a* are the same, lengths A in a longitudinal direction of the upper walls 54 are the same, and radii of curvature of lower edges 53*a* of side walls 53 at the round portions 51*a* are the same, and the round portions 51*a* of the boom sub assemblies 47 and 48 of the three types of boom assemblies 12 are formed by the same press die.

Arc portions of the boom sub assemblies 47 and 48 of plural types of boom assemblies 12 having different length are formed by the same press die, and the front and rear boom sub assemblies 47 and 48 are made symmetric in the front and rear, thereby minimizing press dies for forming the round portions 51*a* of the boom sub assemblies 47 and 48 to reduce costs, and eliminating a press die changing step in production of plural types of boom assemblies 12 having different lengths to increase productivity and reduce labor costs. In the boom sub assemblies 47 and 48 of the three types of boom assemblies 12 having different lengths, lengths B in the longitudinal direction of the upper walls 54 at the linear portions 51*b* are relatively significantly different, and the lengths of the linear portions 51*b* are made different to form the three types of boom assemblies 12 having different lengths.

Forming portions of the notches 58 at the round portions 51*a* of the three types of boom sub assemblies 47 and 48 in FIGS. 4 and 5 have slightly different lengths, but if the arc portions have the same radius of curvature with different lengths, the round portions 51*a* can be formed by the same press die. Thus, the lengths A of the arc portions of the upper walls 54 may be slightly different.

Two types or four or more types of boom assemblies 12 having different lengths may be formed in the same manner.

Figure 6:
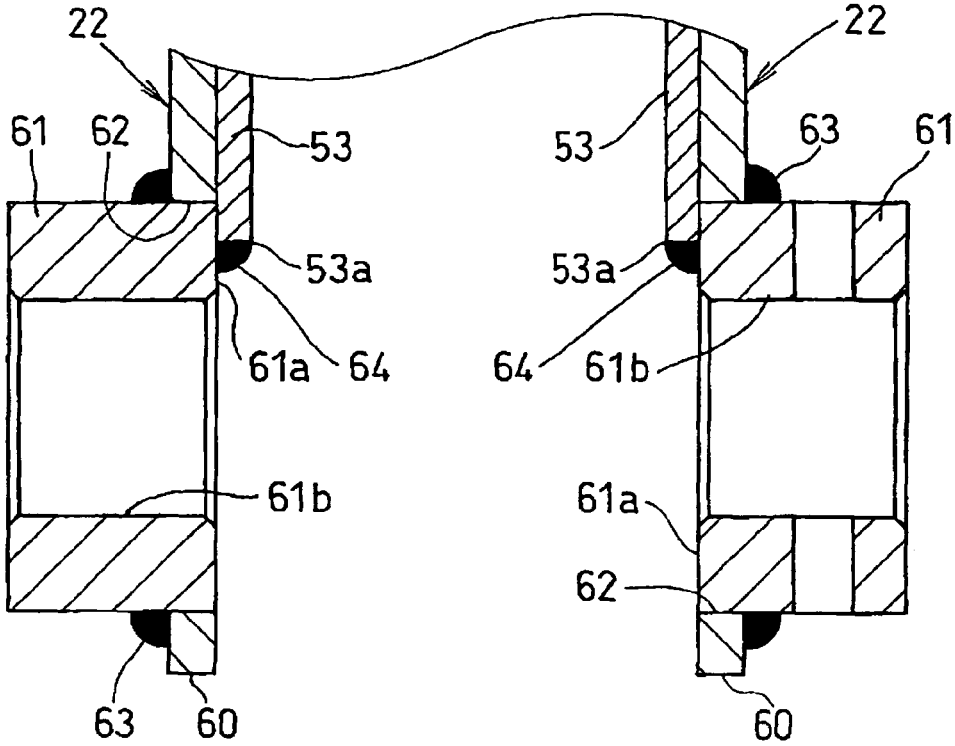
FIG. 6 is a rear sectional view of a pivot connecting portion of a boom cylinder of the boom assembly.
Figure 7:
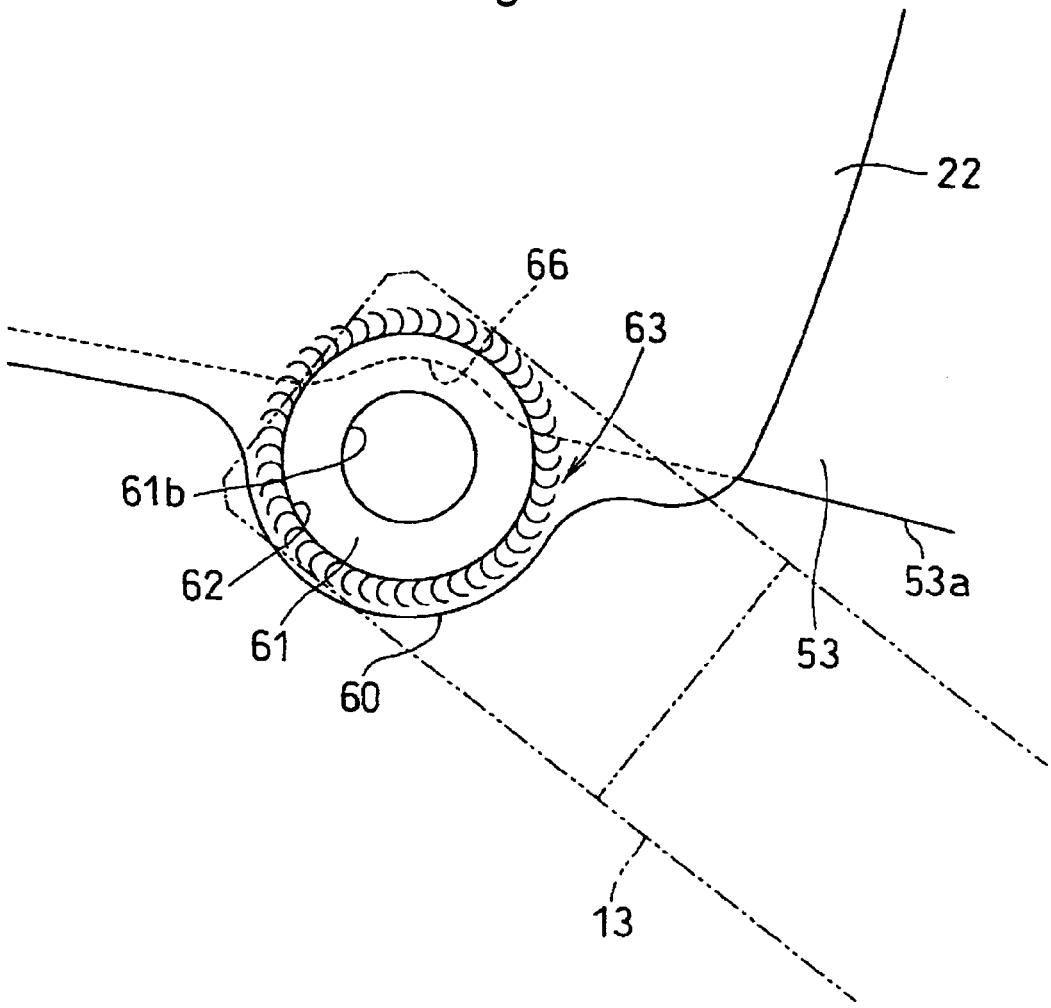
FIG. 7 is a side view of the pivot connecting portion of the boom cylinder of the boom assembly.
Figure 8:
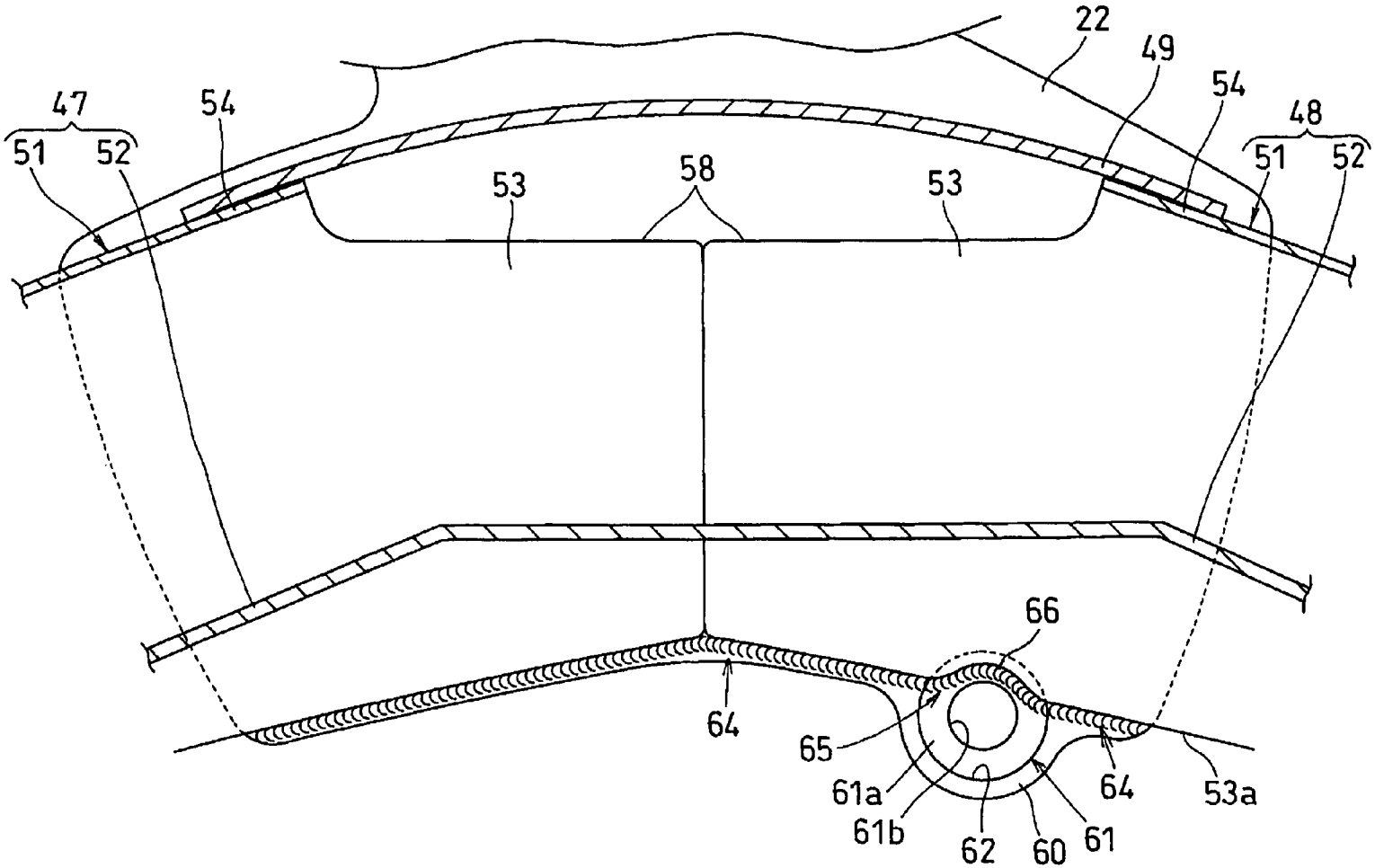
FIG. 8 is a side sectional view of the center in the longitudinal direction of the boom assembly.

As shown in FIGS. 6 to 8, the cylinder pivot portion 60 of each of the right and left bracket plates 22 to which the end of the boom cylinder 13 is pivotably connected is provided with a cylindrical boss 61 that supports the pivot 23 for supporting the boom cylinder 13, and formed with a boss insertion hole 62 through which the boss 61 is inserted.

One end in an axial direction of the boss 61 (a lateral inner end) is inserted through the boss insertion hole 62 from a lateral outer surface of the bracket plate 22, and the boss 61 is joined to the cylinder pivot portion 60 by fillet welding between an outer peripheral surface of the boss 61 and the outer surface of the bracket plate 22. The front end of the boom cylinder 13 is placed between the right and left cylinder pivot portions 60, and the front end of the boom cylinder 13 is pivotably connected to the right and left cylinder pivot portions 60 by the pivot 23 inserted through the right and left bosses 61 and passing through the front end of the boom cylinder 13. According to the above described configuration, the inner end of the boss 61 is inserted from the outer surface of the bracket plate 22 through the boss insertion hole 62 formed in the cylinder pivot portion 60 of the bracket plate 22 to join the outer surface of the cylinder pivot portion 60 and the outer peripheral surface of the boss 61 by welding. Thus, an external force acting on the boss 61 can be received by a welding bead 63 around the boss 61 and the bracket plate 22

(the inner surface of the boss insertion hole 62), thereby reducing load on the welding bead 63 around the boss 61.

An upper portion of an end surface 61*a* at the lateral inner end of the boss 61 laterally overlaps the lower end of the side wall 53 of the rear boom sub assembly 48, the upper portion of the end surface 61*a* at the lateral inner end of the boss 61 abuts against the lower end of the side wall 53 of the rear boom sub assembly 48, and the end surface 61*a* at the lateral inner end of the boss 61 and the lower edge 53*a* of the side wall 53 of the rear boom sub assembly 48 are joined by fillet welding so as not to close an inner hole 61*b* of the boss 61. The lateral inner surface of the bracket plate 22 and the lower edge 53*a* of the side wall 53 of each of the front and rear boom sub assemblies 47 and 48 are joined by fillet welding from the front end to the rear end of the bracket plate 22. A welding bead 64 that joins the lateral inner surface of the bracket plate 22 and the lower edge 53*a* of the side wall 53 of each of the front and rear boom sub assemblies 47 and 48, and a welding bead 65 that joins the end surface 61*a* at the lateral inner end of the boss 61 and the lower edge 53*a* of the side wall 53 of the rear boom sub assembly 48 are continuous.

A portion of the lower edge 53*a* of the side wall 53 of the rear boom sub assembly 48, welded to the end surface 61*a* at the lateral inner end of the boss 61 is formed with an arc-shaped notch 66 along the inner hole 61*b* of the boss 61, and the side wall edge 53*a* of the boom assembly 12 of the portion against which the end surface 61*a* at the lateral inner end of the boss 61 abuts is formed along the inner hole 61*b* of the boss 61. The inner end of the boss 61 is configured to be inserted through the boss insertion hole 62 from the outer surface of the bracket plate 22, and thus the end surface 61*a* at the inner end of the boss 61 and the side wall edge 53*a* of the boom assembly 12 can be joined by welding, and the end surface 61*a* at the inner end of the boss 61 and the side wall edge 53*a* of the boom assembly 12 are joined by welding to significantly reduce stress around the boss 61.

As described above, the boss insertion hole 62 is formed through the cylinder pivot portion 60 of the bracket plate 22, one end in the axial direction of the cylindrical boss 61 is inserted through the boss insertion hole 62 from the outer surface of the bracket plate 22, the outer surface of the cylinder pivot portion 60 and the outer peripheral surface of the boss 61 are joined by welding, and the end surface 61*a* of one end in the axial direction of the boss and the side wall edge 53*a* of the boom assembly 12 are joined by welding so as not to close the inner hole of the boss 61.

The end surface 61*a* of one end in the axial direction of the boss 61 of the portion welded to the side wall edge 53*a* of the boom assembly 12 abuts against the outer surface of the side wall 53 of the boom assembly 12, and the side wall edge 53*a* of the boom assembly 12 of the portion against which the end surface 61*a* of one end in the axial direction of the boss 61 abuts is formed along the inner hole 61*b* of the boss 61.

According to the present invention, one end in the axial direction of the boss 61 is inserted through the boss insertion hole 62 formed in the cylinder pivot portion 60 of the bracket plate 22 from the outer surface of the bracket plate 22 to join the outer surface of the cylinder pivot portion 60 and the outer peripheral surface of the boss 61 by welding, and thus an external force acting on the boss can be received by the welding bead around the boss and the bracket plate. This reduces load on the welding bead around the boss 61. One end in the axial direction of the boss 61 is inserted through the boss insertion hole 62 from the outer surface of the bracket plate 22, and thus the end surface 61*a* of one end in the axial direction of the boss 61 and the side wall edge 53*a* of the boom assembly 12 can be joined by welding. Then, the end surface 61*a* of one end in the axial direction of the boss 61 and the side wall edge 53*a* of the boom assembly 12 are joined by welding to significantly reduce stress around the boss 61. This ensures strength against the external force acting on the boss 61, eliminates the need for increasing an outer diameter of the boss 61 or providing a reinforcing plate for ensuring the strength of the boss 61, reduces costs, and improves design.

What is claimed is:

1. A boom assembly bent at the center in a longitudinal direction so as to form a round shape protruding upward when seen from the side, comprising;

a front boom sub assembly, said front boom sub assembly constituting the front of the center in the longitudinal direction of said boom assembly; and a rear boom sub assembly, said rear boom sub assembly constituting the rear of the center in the longitudinal direction of said boom assembly, wherein said front boom sub assembly and said rear boom sub assembly are symmetric to each other when seen from the side, and portions from the midway positions in the longitudinal direction of said front boom sub assembly and said rear boom sub assembly to the center in the longitudinal direction of the boom assembly have upper surfaces of arc shape protruding upward when seen from the side, and portions from the middles in the longitudinal direction of said front boom sub assembly and said rear boom sub assembly to ends in the longitudinal direction of the boom assembly have upper surfaces of linear shape when seen from the side.

2. The boom assembly according to claim 1, wherein bodies of said front boom sub assembly and said rear boom sub assembly are formed into an inverted u-shape in section by right and left side walls and an upper wall connecting upper edges of the right and left side walls.

3. The boom assembly according to claim 1, wherein the boom assembly includes an operating tool swingably at a front end of said boom assembly, and is used in a loader in which a hydraulic cylinder that swings the operating tool is placed in an upper front of said boom assembly.

4. The boom assembly according to claim 2, wherein the boom assembly includes an operating tool swingably at a front end of said boom assembly, and is used in a loader in which a hydraulic cylinder that swings the operating tool is placed in an upper front of said boom assembly.

5. A boom assembly bent at the center in a longitudinal direction so as to form a round shape protruding upward when seen from the side, comprising;

a front boom sub assembly, said front boom sub assembly constituting the front of the center in the longitudinal direction of said boom assembly; and a rear boom sub assembly, said rear boom sub assembly constituting the rear of the center in the longitudinal direction of said boom assembly, wherein said front boom sub assembly and said rear boom sub assembly are symmetric to each other when seen from the side, and portions from the midway positions in the longitudinal direction of said front boom sub assembly and said rear boom sub assembly to the center in the longitudinal direction of the boom assembly have upper surfaces of arc shape protruding upward when seen from the side, and portions from the middles in the longitudinal direction of said front boom sub assembly and said rear boom sub assembly to ends in the longitudinal direction of the boom assembly have upper surfaces of linear shape when seen from the side;

wherein bodies of said front boom sub assembly and said rear boom sub assembly are formed into an inverted u-shape by right and left side walls and an upper wall connecting upper edges of the right and left side walls, a bottom plate connecting the right and left side walls; and wherein said bottom plate includes a first flat portion extending substantially parallel to an upper wall of the front boom sub assembly from a longitudinal remote end to a longitudinal intermediate portion thererof, a second flat portion extending substantially parallel to an upper wall of the rear boom sub assembly from a longitudinal remote end to a longitudinal intermediate portion thereof; and a third flat portion connecting said first and second flat portions.

6. The boom assembly according to claim 5, wherein said bottom plate is formed by bending a one-piece flat sheet.

7. The boom assembly according to claim 5, wherein the boom assembly includes an operating tool swingably at a front end of said boom assembly, and is used in a loader in which a hydraulic cylinder that swings the operating tool is placed in an upper front of said boom assembly.

* * * * *

UNITED STATES PATENT AND TRADEMARK OFFICE

CERTIFICATE OF CORRECTION

PATENT NO. : 7,520,713 B2
APPLICATION NO. : 11/519216
DATED : April 21, 2009
INVENTOR(S) : Nishi et al.

It is certified that error appears in the above-identified patent and that said Letters Patent is hereby corrected as shown below:

Column 11, Line 1 of Claim 5, after "u-shape", insert -- in section --

Signed and Sealed this

Fourth Day of August, 2009

JOHN DOLL
*Acting Director of the United States Patent and Trademark Office*